US006297463B1

(12) United States Patent
Hills

(10) Patent No.: US 6,297,463 B1
(45) Date of Patent: Oct. 2, 2001

(54) OUT-OF-FLUID DETECTOR FOR RECIPROCATING PUMPS

(75) Inventor: William M. Hills, Walcott, CT (US)

(73) Assignee: Sealed Air Corporation (U.S.), Danbury, CT (US)

( * ) Notice: Subject to any disclaimer, the term of this patent is extended or adjusted under 35 U.S.C. 154(b) by 0 days.

(21) Appl. No.: 09/499,102

(22) Filed: Feb. 4, 2000

Related U.S. Application Data

(62) Division of application No. 09/144,232, filed on Aug. 31, 1998.

(51) Int. Cl.[7] ..... H01H 35/02
(52) U.S. Cl. ..... 200/61.45 M; 200/61.53
(58) Field of Search ..... 200/61.53, 61.45 M, 200/61.46, 276, 276.1, 61.48, 61.45 R; 73/652, 654; 340/683; 335/205, 206, 207

(56) References Cited

U.S. PATENT DOCUMENTS

| | | | | |
|---|---|---|---|---|
| 1,868,923 | * | 4/1932 | Semon . | |
| 3,414,853 | * | 12/1968 | Motis . | |
| 3,781,496 | | 12/1973 | Jones, Jr. . | |
| 3,909,569 | * | 9/1975 | Jones | 200/61.53 |
| 4,155,067 | | 5/1979 | Gleeson . | |
| 4,176,390 | | 11/1979 | Galbert . | |
| 4,257,747 | | 3/1981 | Goldman . | |
| 4,269,223 | | 5/1981 | Carter et al. . | |
| 4,547,771 | | 10/1985 | Rockwood et al. . | |
| 4,665,393 | | 5/1987 | Wilder et al. . | |
| 4,746,774 | | 5/1988 | Tetrault et al. . | |
| 4,789,762 | | 12/1988 | Miller et al. . | |
| 4,789,769 | | 12/1988 | Warner . | |
| 4,873,401 | * | 10/1989 | Ireland | 200/61.45 M |
| 4,916,266 | | 4/1990 | Tetrault . | |
| 5,174,722 | | 12/1992 | Lybecker . | |
| 5,440,084 | * | 8/1995 | Fuse et al. | 200/61.45 M |
| 5,483,225 | | 1/1996 | Hwang . | |
| 5,601,413 | | 2/1997 | Langley et al. . | |
| 5,706,911 | * | 1/1998 | Maiwald et al. | 200/61.53 |
| 5,726,403 | * | 3/1998 | Sondergold et al. . | |
| 6,087,951 | * | 7/2000 | Ramsden et al. | 200/61.45 M |

* cited by examiner

*Primary Examiner*—David J. Walczak
*Assistant Examiner*—Khoa D. Huynh
(74) *Attorney, Agent, or Firm*—Alston & Bird LLP

(57) ABSTRACT

A dynamic displacement sensor for detecting an out-of-fluid condition in a liquid delivery system detects an increased amplitude of pump motion of a reciprocating air pump and provides an output signal upon detecting the increased amplitude motion. The detector includes a spring-mass combination supported within a housing such that the mass is movable along a defined axis of the housing, with the spring applying a restoring force to the mass when the mass moves away from its static position. The detector is attached to the pump with its defined axis aligned parallel with the pump axis. A sensor within the housing is triggered to change state when the mass is displaced by pump motion of a predetermined amplitude and frequency, thereby providing an output signal indicating an out-of-fluid condition.

2 Claims, 6 Drawing Sheets

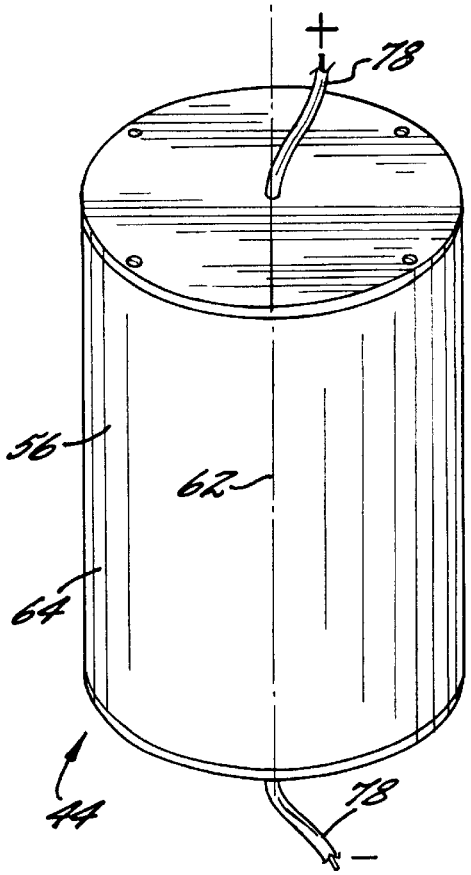
Fig. 2.
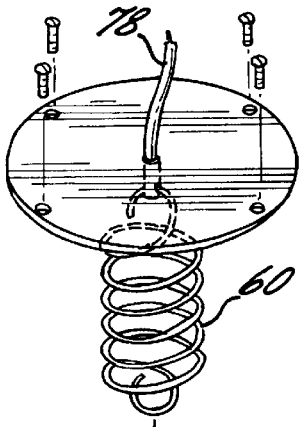
Fig. 3.
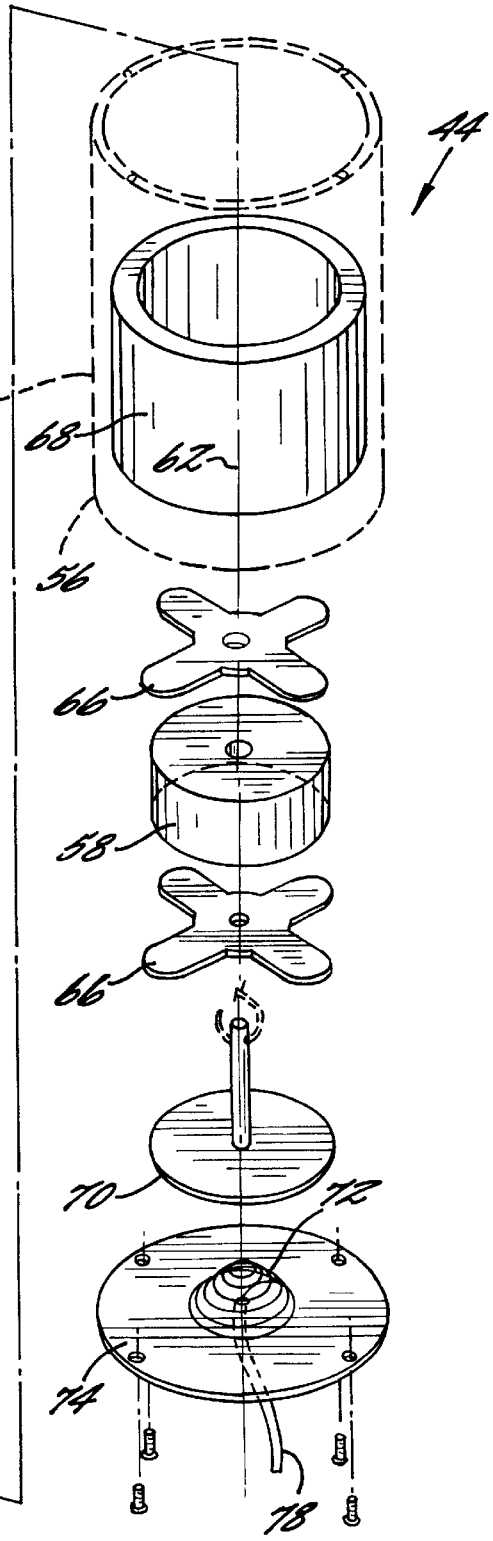

OUT-OF-FLUID DETECTOR FOR RECIPROCATING PUMPS

CROSS-REFERENCE TO RELATED APPLICATION

This is a divisional of U.S. patent application Ser. No. 09/144,232 filed Aug. 31, 1998, currently pending.

FIELD OF THE INVENTION

The present invention relates to fluid level detectors and, more particularly, to detectors for determining when a supply of fluid being pumped by a pump has become depleted.

BACKGROUND OF THE INVENTION

Reciprocating pumps are frequently used in a variety of industrial applications for pumping liquids from storage containers. For example, pneumatic piston pumps are often used for pumping liquids from drums, barrels, plastic containers, or the like. In many applications, it is undesirable to allow the pumps to run dry for any significant length of time. For instance, unless an out-of-fluid condition is detected and the downstream process or operation employing the pumped liquid is interrupted, faulty downstream operations will be performed, or the downstream operations will be rendered impossible, because the required liquid will not be supplied. Thus, it is desirable to detect an out-of-fluid condition so that the pumps may be stopped as soon as possible and the pump connected to a new liquid supply to continue the downstream operations.

U.S. Pat. No. 4,269,223 discloses a detector for detecting an out-of-fluid condition in an air pump by sensing an increased rate of air flow to the pump which occurs when the pump runs dry. The device is installed in the line that supplies pressurized air to the air pump. The device shuts off the air flow when the increased air flow is detected. A disadvantage of the device is that if the air supply pressure to the pump changes, the device must be adjusted or it will either close prematurely or fail to close at all.

SUMMARY OF THE INVENTION

The present invention overcomes the drawback noted above by detecting an increased amplitude of pump motion indicating an out-of-fluid condition. In accordance with the invention, the pump is supported on or adjacent the container so that the pump is free to move in the direction of its pump axis along which the internal piston of the pump moves. When the liquid in the container falls below the level of the pump's intake opening, the pump begins to pump air rather than liquid. As a result, the entire pump begins to reciprocate with an increased amplitude along the pump axis direction. The magnitude of this reciprocating motion of the pump is substantially larger than the normal pump motion that occurs when the pump is pumping liquid.

The apparatus and method of the invention depend on detecting this increased-amplitude pump motion. Specifically, the invention in one embodiment provides a liquid delivery system including a pump supported as described above, and further including a detector mounted on the pump for movement therewith. The detector is operable to detect an increase in amplitude of the pump motion and to provide a signal indicating an out-of-fluid condition upon detecting the increased amplitude motion.

In a preferred embodiment of the invention, the detector comprises a mass supported within a housing in a predetermined static position with respect thereto and movable away from the static position along a defined axis. The mass is constrained against movement except along the defined axis. A sensor is located in the detector and is operable to change state (i.e., to close, or to open, or to otherwise change the state existing on an electrical line connected to the sensor) when the mass is displaced away from its static position along the defined axis by a predetermined distance. A spring is connected between the mass and the housing for applying a restoring force to the mass tending to move the mass toward the static position upon displacement of the mass away therefrom. An output line is connected to the sensor.

In use, the detector is attached to the pump with the defined axis of the device aligned along or parallel to the pump axis. During normal movement of the pump that occurs when liquid is being pumped, the movement of the mass along the defined axis is not of sufficient amplitude to cause a state change of the sensor. However, when the pump begins to pump air and move with an increased amplitude, the amplitude of the mass's movement increases and causes the mass to trigger the state change of the sensor. The state change may be used to activate a signal telling an operator to shut off the pump, or alternatively or additionally may be used to automatically shut off the pump.

In a preferred embodiment of the invention, the detector includes a stop which the mass abuts in the static position. The stop defines the static position for the mass. The stop substantially constrains the mass to movement in only one direction away from the static position during oscillation of the mass. Advantageously, the spring is preloaded in tension in the static position of the mass, so that the mass is urged against the stop in the static condition. The stop advantageously comprises a shock-absorbing member for limiting bounce of the mass upon being returned to the static position by the restoring force of the spring.

In accordance with another preferred embodiment of the invention, the sensor comprises a first contact supported on the mass and a second contact supported on the housing spaced from the first contact in the static condition of the mass. The sensor is triggered by displacement of the mass which causes the first contact to come into contact with the second contact.

In accordance with a further embodiment of the invention, the sensor comprises a magnetically operated proximity sensor mounted to the housing. The detector further includes a magnet affixed to the mass. The sensor is triggered by displacement of the mass which causes the magnet to be carried into proximity with the proximity sensor.

In a still further embodiment of the invention, the detector has a pair of proximity sensors mounted to the housing at different axial distances from the mass. Thus, the sensor nearer the mass can be used when a greater sensitivity of the detector is desired (i.e., the nearer sensor is triggered by smaller amplitude displacement of the mass), and the sensor farther away from the mass can be used when a lesser sensitivity is desired.

BRIEF DESCRIPTION OF THE DRAWINGS

Additional objects, features, and advantages of the invention will become apparent from the following description of specific embodiments thereof taken in conjunction with the accompanying drawings in which:

FIG. 2 is a perspective view of a detector in accordance with the invention;

FIG. 3 is an exploded perspective view of the detector;

DETAILED DESCRIPTION OF THE DRAWINGS

Figure 1:
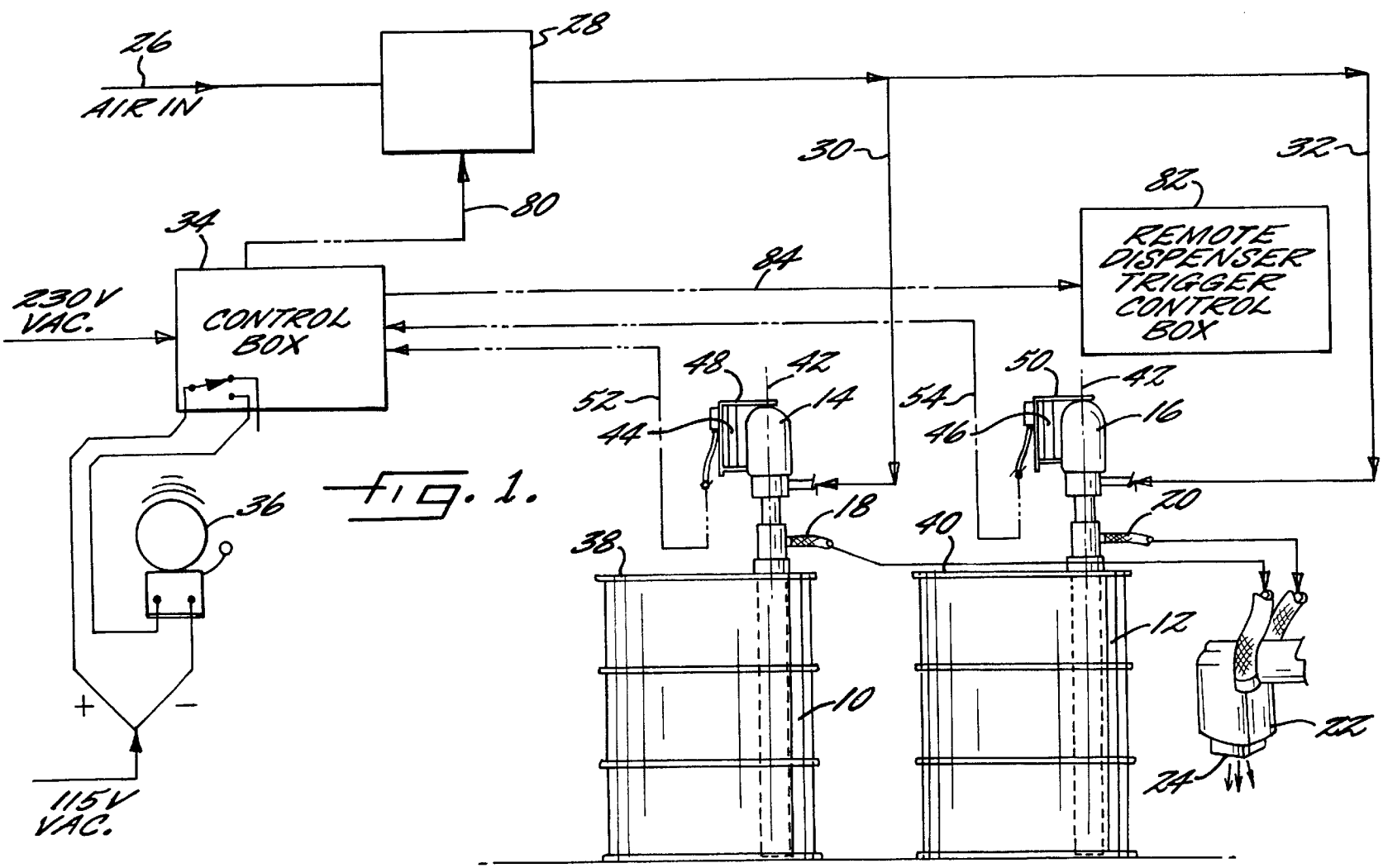
FIG. 1 schematically depicts a system for pumping two chemicals denoted A and B from separate containers using two reciprocating air pumps, each pump including a detector in accordance with the invention connected to a control box for automatically shutting off the air supply to the respective pump and activating a bell when the detector detects pump movement indicating an out-of-fluid condition.

FIG. 1 depicts a chemical pumping and delivery system for supplying two chemicals denoted A and B to a downstream operation. The A chemical is contained in a drum 10 and the B chemical is contained in a drum 12. Reciprocating piston-type air pumps 14 and 16 pump the A and B chemicals through supply lines 18 and 20, respectively, to the downstream operation which in the illustrative example of FIG. 1 comprises a dispenser 22 which mixes the A and B chemicals together and dispenses them through a dispenser outlet 24.

Pumps 14 and 16 are operated by pressurized air from a suitable source (not shown). Pressurized air from the source is delivered through a main air line 26 to an air solenoid valve 28. Air is delivered from the solenoid valve 28 through air lines 30 and 32 to the pumps 14 and 16, respectively. The solenoid valve 28 is normally closed when it is not supplied with electrical power, so that the pumps will not be operated if electrical power fails. Electrical power is supplied to the solenoid valve 28 from a control box 34. As further described below, the control box 34 is adapted to interrupt electrical power to the solenoid valve 28 when the control box 34 receives a signal indicating an out-of-fluid condition in either of the drums 10 or 12, so that the pumps 14 and 16 are automatically stopped when either the A or B chemical runs out. The control box 34 also activates a signal device such as a bell 36 simultaneously with interrupting power to the solenoid valve 28, so as to signal an operator that an out-of-fluid condition has occurred.

Each of the pumps 14 and 16 is supported adjacent the top wall 38 and 40 of the respective drums 10 and 12. The pump column 41 of each pump extends through a hole in the respective top wall and the lower end of the pump column 41 is adjacent the bottom 43 of the drum. The pumps are oriented with their axes 42 generally vertical. The pumps 14 and 16 are supported such that they are generally free to move in the direction along their pump axes 42.

Dynamic displacement detectors 44 and 46 are attached via brackets 48 and 50 to the pumps 14 and 16, respectively, so that the detectors 44 and 46 move with the pumps 14 and 16. The detectors 44 and 46 have output lines 52 and 54, respectively, which are connected to the control box 34.

The construction and operation of the detectors 44 and 46 are now described with reference to FIGS. 2–5, which depict a detector 44 in accordance with one embodiment of the invention, it being understood that detector 46 is identical. The detector 44 includes a housing 56, a mass 58 contained in the housing 56, and a spring 60 connected between the mass 58 and the housing 56. The mass 58 is constrained against movement except along a defined axis 62 of the detector 44. In the preferred embodiment of the invention depicted in FIGS. 2–5, the housing 56 comprises a cylindrical tube closed at both ends and the mass 58 is a generally cylindrical body, and the cylindrical side wall 64 of the housing 56 is slightly larger in diameter than the outer diameter of the mass 58 so that the mass 58 is free to move along the axis 62 of the cylinder but is substantially prevented from moving in any other direction. The mass 58 includes a pair of centering disks 66 with outer diameters slightly smaller than the inner diameter of the housing 56 for keeping the mass 58 generally centered in the housing 56. The centering disks 66 advantageously are shaped so that air can freely move past the disks when the mass is oscillating within the housing so that air damping of the mass's movement is minimized.

Figure 4:
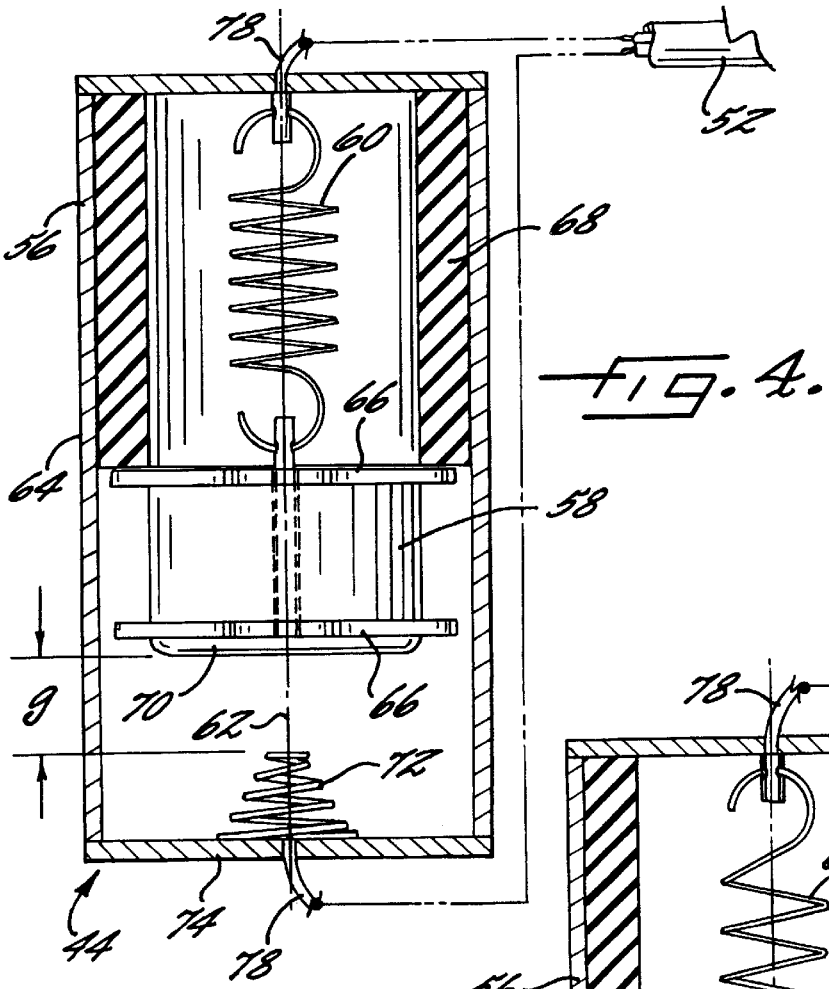
FIG. 4 is a longitudinal cross-sectional view of a detector in accordance with a preferred embodiment of the invention with the mass shown in the static position.

The detector 44 includes a shock-absorbing stop 68 against which the mass 58 abuts to define a predetermined static position of the mass 58, as shown in FIG. 4. Advantageously, the spring 60 is adapted to apply a small preload urging the mass 58 against the stop 68 in the static condition of the detector 44. The preload is small in relation to the force exerted on the detector 44 by the pump 14 when it runs dry, and thus does not have a significant impact on the response of the detector 44.

A contact plate 70 is affixed to the lower centering disk 66 of the mass 58. A contact spring 72 is affixed to the end wall 74 of the housing 56 opposite from the contact plate 70. A predetermined displacement gap g is set between the contact plate 70 and the contact spring 72.

Figure 5:
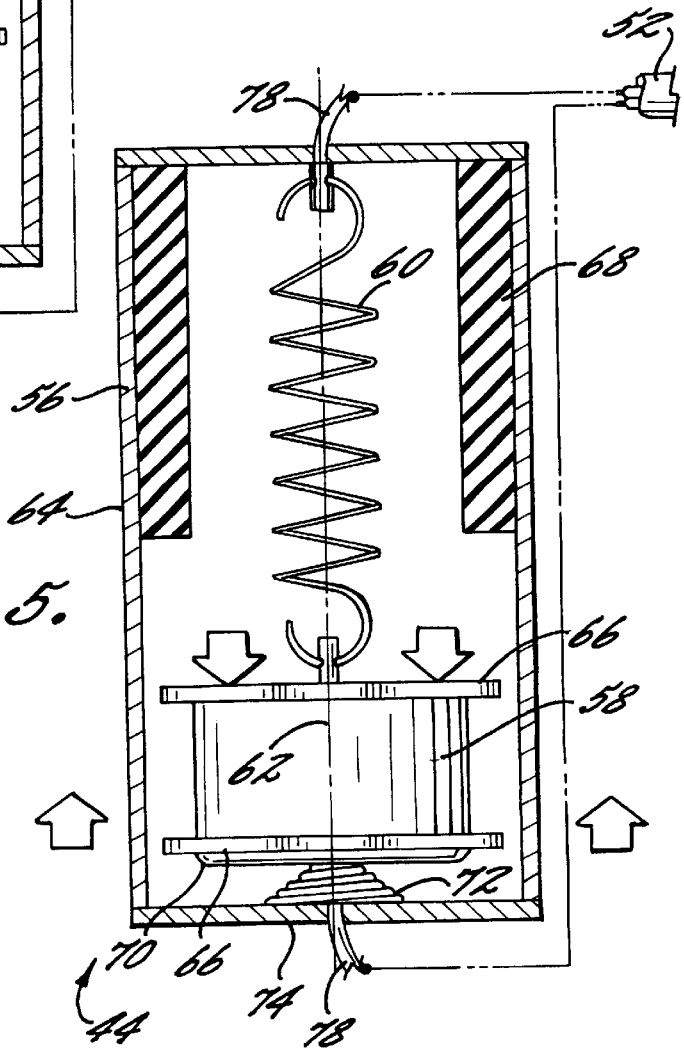
FIG. 5 is a view similar to FIG. 4, showing the detector in a dynamic displacement condition in which the contacts of the detector have closed.
Figure 6:
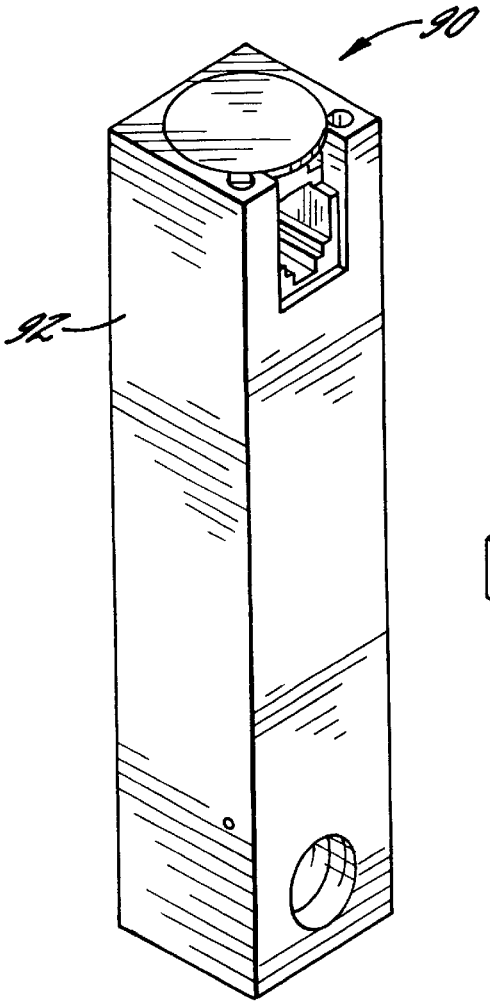
FIG. 6 is a perspective view of another embodiment of a detector in accordance with the invention.
Figure 7:
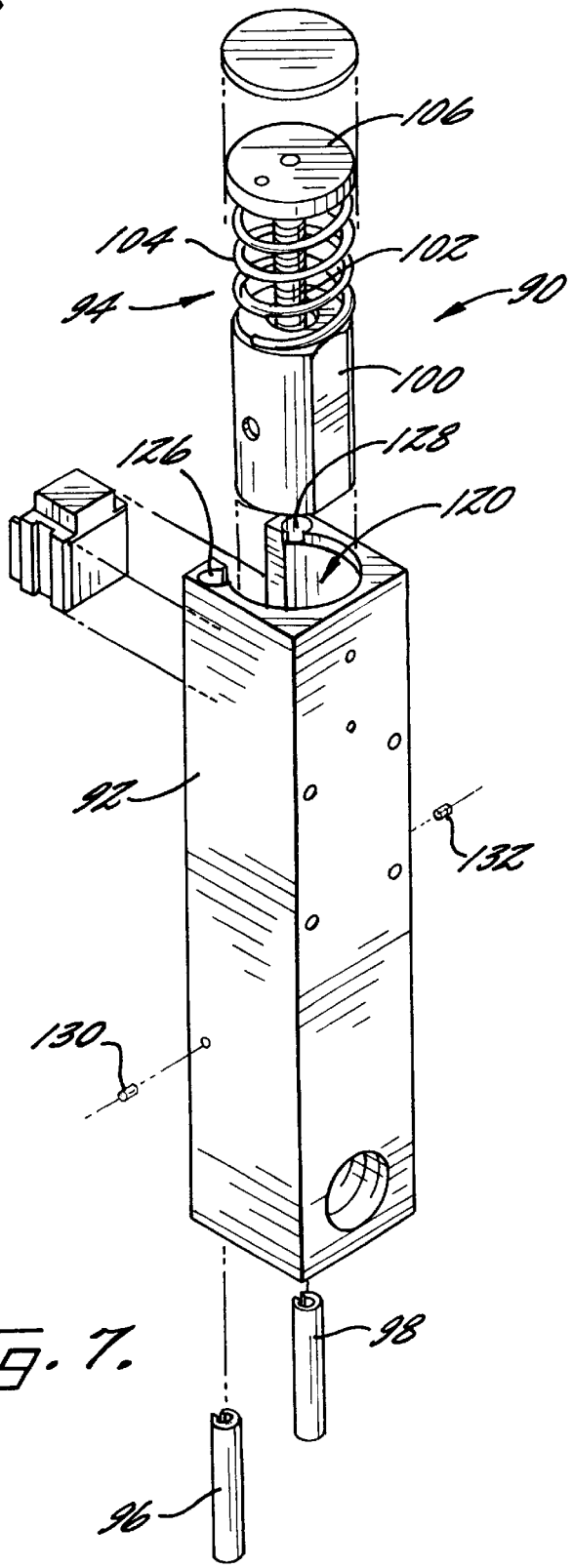
FIG. 7 is an exploded perspective view of the detector of FIG. 6.
Figure 8:
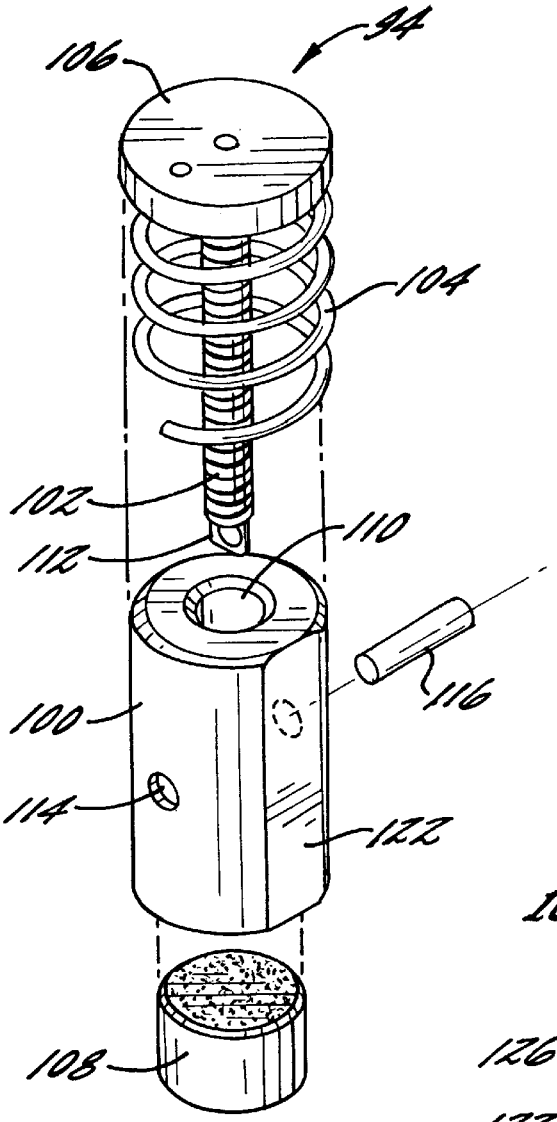
FIG. 8 is an exploded perspective view of the spring-mass subassembly of the detector of FIG. 6.
Figure 9:
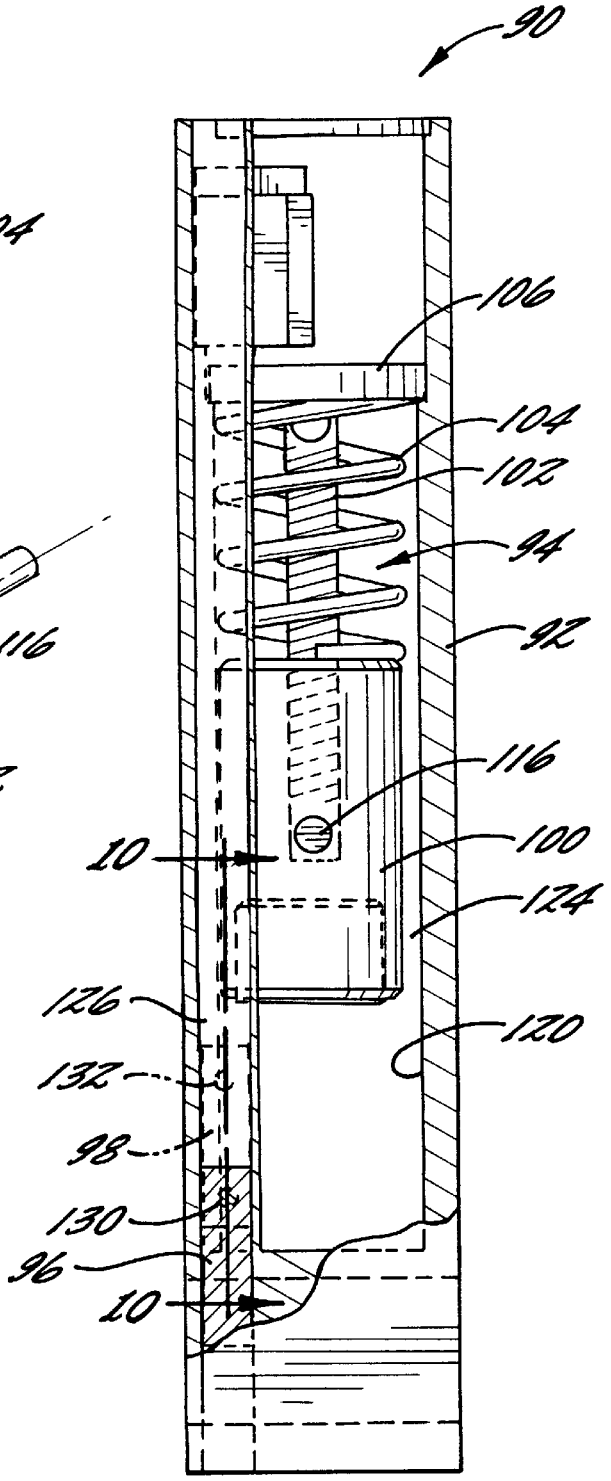
FIG. 9 is a side elevational view partly in section, showing the detector of FIG. 6 in a static condition.

FIG. 5 shows the detector 44 after a dynamic displacement of sufficient magnitude has been imposed on the detector 44 in the direction of arrow 76 so as to cause the housing 56 and contact spring 72 to rise with respect to the mass 58 and bring the contact spring 72 into contact with the contact plate 70. A restoring spring force F is applied to the mass 58 by the spring 60 tending to return the mass 58 to its initial static position relative to the housing.

The stop 68 advantageously comprises a shock-absorbing material which absorbs the return energy of the mass 58 when the mass 58 impacts the stop 68 upon being returned to its static position by the spring 60. The stop 68 thus reduces the tendency of the mass 58 to bounce back from the stop 68 toward the contact spring 72.

It will be appreciated that closure of the contacts 70 and 72 depends on both the displacement magnitude or amplitude of pump motion and the frequency of the pump motion. The natural frequency of the combination of mass 58 and spring 60 is lower than the frequency of the pump motion, and the displacement gap g is somewhat smaller than the amplitude of the pump motion to be detected but substantially larger than the amplitude of normal pump motion when the pump 14 is pumping liquids. Thus, during normal pump motion, the contacts do not close. However, when the pump begins to pump air and its amplitude of motion increases, the contacts close.

The contacts 70 and 72 are connected to the leads 78 of the output line 52. When the contacts close, the output line 52 carries a signal to the control box 34. In response to the signal from line 52, the control box 34 interrupts electrical power delivered to the solenoid valve 28 via line 80, and the solenoid valve 28 closes, thereby shutting off air supply to both pumps 14 and 16. The control box 34 also activates the bell 36. The operation of the detector 46 attached to the pump 16 is identical to the operation of the detector 44. Thus, whenever an out-of-fluid condition occurs in either of the drums 10 or 12, both pumps 14 and 16 are stopped and the bell 36 is rung to signal to the operator that liquid has run out in one of the drums.

The control box 34 also communicates with a remote dispenser trigger control box 82 via a line 84. The dispenser trigger control box 82 enables or disables a trigger (not shown) on the dispenser 22 which effects dispensing of the mixed A and B chemicals through dispenser outlet 24. When the control box 34 receives a signal indicating an out-of-fluid condition, a signal is passed to the dispenser trigger control box 82, which disables the trigger so that dispensing of chemical is halted.

It will be appreciated that various types of displacement sensors may be used without departing from the scope of the invention. Thus, accelerometers and other types of sensors can be used as long as they are capable of detecting an increased amplitude pump motion when the pump runs dry.

Figure 10:
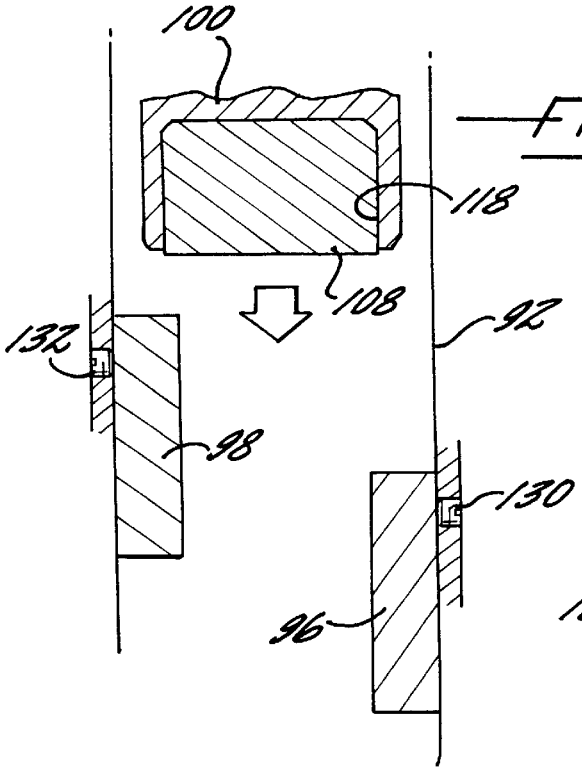
FIG. 10 is a schematic sectioned side view of the mass and two proximity sensores of the detector of FIG. 6, showing the mass being displaced toward the sensores but not yet positioned to trigger either sensor.
Figure 11:
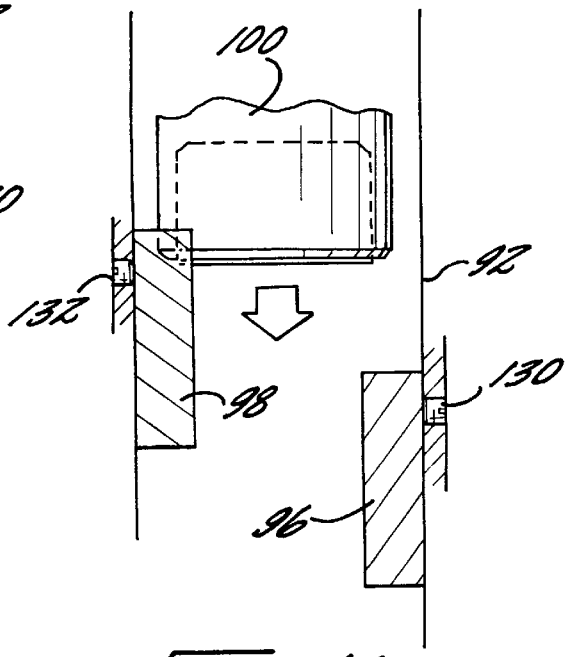
FIG. 11 is a view similar to FIG. 10, showing the mass in position to trigger the upper sensor.
Figure 12:
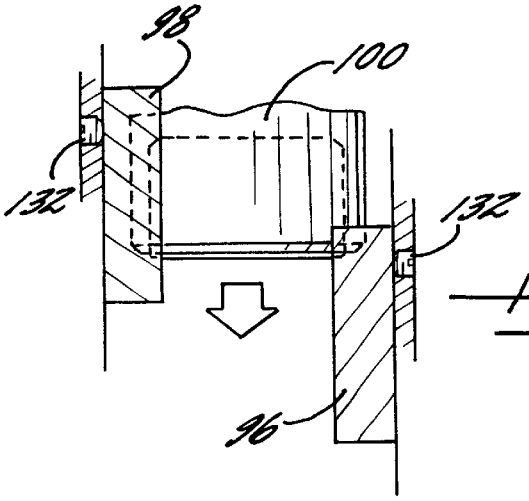
FIG. 12 is a view similar to FIGS. 10 and 11, showing the mass in position to trigger the lower sensor.

An alternative preferred embodiment of a detector in accordance with the invention is depicted in FIGS. 6–9 and its operation is illustrated in FIGS. 10–12. The detector 90 comprises a housing 92, a spring-mass assembly 94 contained within the housing, and a pair of magnetically operated proximity sensors 96 and 98 retained in the housing. The proximity sensors 96 and 98 advantageously comprise reed switches, but various types of proximity sensors can be used.

The spring-mass assembly 94 comprises a mass 100, a spring 102 attached to the mass 100, a shock-absorbing member or spring 104, a support plate 106 which serves as an attachment member for the spring 102 and for the shock-absorbing spring 104, and a magnet 108 which is affixed to the mass 100. The mass 100 comprises a generally cylindrical body. In one end of the mass 100 is formed a longitudinal bore 110 which accepts the end portion of the spring 102. The spring 102 includes an attachment fixture 112 affixed to the end of the spring. A transverse hole 114 extends through the mass 100 and opens into the bore 110. The mass 100 is affixed to the spring 102 by a pin 116 which extends through the transverse hole 114 and engages the attachment fixture 112 on the spring 102. The opposite end of the mass 100 includes a cavity 118 (FIG. 10) within which the magnet 108 is secured.

The housing 92 defines a longitudinal bore 120 within which the spring-mass assembly 94 is mounted. The mass 100 is slightly smaller in diameter than the bore 120 so the mass freely slides longitudinally therein but is substantially constrained from moving in other directions. Advantageously, the mass 100 includes at least one flattened portion 122 such that an air flow path 124 is defined between the mass 100 and the inner surface of the bore 120 to allow air to flow freely past the mass and thereby minimize air damping thereof.

The housing 92 further includes a pair of passages 126 and 128 which extend longitudinally along the housing adjacent two of the corners of the housing. The passages 126 and 128 receive the proximity sensors 96 and 98, respectively. The sensors are positioned in the passages 126 and 128 at two different predetermined axial distances from the mass 100, and are secured in those positions by a pair of set screws 130 and 132. As illustrated in FIGS. 10–12, this arrangement of the proximity sensors allows the detector 90 to have two different sensitivities.

Thus, with reference to FIGS. 10–12, a sequence of views representing three instants in time are depicted for an upward movement of the detector. In FIG. 10, the mass 100 and sensors 96 and 98 are shown with the mass in the static position at the instant when the upward movement of the detector has just begun. The mass 100 begins to move relative to the housing 92 toward the sensors 96 and 98. In FIG. 11, the mass 100 has relatively moved a sufficient distance to bring the magnet 108 into proximity with the proximity sensor 98 so as to trigger the sensor 98 to change state (i.e., to open or close, or otherwise change the state existing on an electrical line connected to the sensor). Thus, if the sensor 98 is being used by the control box 34 (FIG. 1) to judge when an out-of-fluid condition has occurred, the pump to which the detector is attached will be shut off and/or the bell 36 or other signal device will be activated. It will be appreciated that the sensor 98 will be triggered by pump motion of a smaller amplitude than that required to trigger the other proximity sensor 96.

FIG. 12 depicts the detector responding to an upward motion of greater amplitude sufficient to bring the magnet 108 into proximity with the lower sensor 96. If the control box 34 is using the lower sensor 96 to judge when an out-of-fluid condition has occurred, the upper sensor 98 will be ignored and the change in state of the lower sensor 96 will determine when the pump should be shut off or the signal device activated. It will be understood that selection of which of the sensors 96, 98 will be used to control pump shut-off can be made by a switch (not shown) which alternatively places one or the other of the sensors in the circuit via the lines 52 and 54 as shown in FIG. 1.

The detector 90 having the capability of two different sensitivities is advantageous where chemical on different occasions may be pumped from two different types of containers, for example, a metal drum versus a plastic container, which have different mechanical characteristics and therefore result in pump motions of different amplitudes.

While the invention has been described by reference to specific embodiments thereof, and while these embodiments have been described in considerable detail, the invention is not limited to these embodiments and details. Modifications of the described embodiments will readily occur to those of ordinary skill in the art. For example, while the detector 44 has been described as including a contact spring 72, other types of contacts or sensors may be used for detecting when the mass has closed the predetermined displacement gap, including proximity sensors, optical sensors, or other types of sensors which are well known in the art. Furthermore, while the pumps have been described as being supported atop the containers, they may alternatively be supported on an adjacent surface. Additionally, the pumps need not be oriented with their pump axes vertical. Other modifications will readily occur to those skilled in the art. Accordingly, the invention is not limited to the embodiments which have been described and illustrated, and the scope of the invention is to be determined by reference to the appended claims.

What is claimed is:

1. A detector for sensing dynamic displacement, comprising:

a housing defining a longitudinal axis;

a mass supported within the housing and constrained against movement except along the longitudinal axis, the mass being movable along the longitudinal axis with respect to the housing, the mass having a magnet affixed thereto;

a shock-absorbing member positioned in the housing adjacent the mass so as to define a stop against which the mass abuts when the detector is static;

a spring contained within the housing, a first end of the spring connected to the housing for movement therewith and a second end of the spring connected to the mass for movement therewith, the spring being preloaded to urge the mass against the shock-absorbing member when the detector is static;

a first magnetically operated proximity sensor operable to change state upon occurrence of a predetermined displacement of the mass away from a static position of the mass carrying the magnet into proximity with the first proximity sensor; and a second magnetically operated proximity sensor axially displaced relative to the first proximity sensor, the two proximity sensors being axially spaced at different distances from the mass when the mass is in the static position such that two different sensitivities of the detector can be achieved.

2. The detector of claim 1, wherein the shock-absorbing member comprises a spring.

* * * * *